United States Patent [19]

Banno et al.

[11] Patent Number: 4,518,353

[45] Date of Patent: May 21, 1985

[54] VACUUM SINTERING FURNACE

[75] Inventors: Takashi Banno, Sakai; Tadashi Seki, Toyonaka; Masafumi Kawaguchi, Niigata; Yukio Tanaka, Niigata; Morikatsu Iwasaki, Niigata; Toshio Nagasawa, Niigata, all of Japan

[73] Assignees: Chugai Ro Co., Ltd., Osaka; Mitsubishi Kinzoku Kabushiki Kaisha, Tokyo, both of Japan

[21] Appl. No.: 624,611

[22] Filed: Jun. 26, 1984

[30] Foreign Application Priority Data

Jun. 27, 1983 [JP] Japan ..... 58-116688

[51] Int. Cl.[3] ..... F27B 5/04

[52] U.S. Cl. ..... 432/205; 432/203; 432/152; 432/162; 432/189

[58] Field of Search ..... 432/128, 203, 130, 205, 432/136, 137, 141, 144, 152, 153, 162, 189

[56] References Cited

U.S. PATENT DOCUMENTS

| | | | |
|---|---|---|---|
| 3,063,878 | 11/1962 | Wilson | 432/128 |
| 3,071,356 | 1/1963 | Duffy | 432/128 |
| 3,778,221 | 12/1973 | Bloom | 432/128 |
| 3,982,887 | 9/1976 | Kendziora et al. | 432/128 |
| 4,047,886 | 9/1977 | Heryrand | 432/128 |
| 4,141,373 | 2/1979 | Kantanson et al. | 432/205 |
| 4,321,031 | 3/1982 | Woodgate | 432/152 |
| 4,397,451 | 8/1983 | Kinoshita et al. | 432/128 |

*Primary Examiner*—Henry C. Yuen

*Attorney, Agent, or Firm*—Jackson, Jones & Price

[57] ABSTRACT

The disclosure relates to a vacuum sintering furnace having a lubricant eliminating section, sintering section and cooling section which are aligned in series and connected by connecting hood means to each other so that a workpiece may be directly transferred to the following section without exposure of the workpiece to outside air. The connecting hood means comprises doors for selectively opening and closing the boundaries between the neighboring sections. Furthermore, the lubricant eliminating section is provided with a lubricant trapping device mounted on an exhaust line connecting a furnace body and a vacuum pump to each other, thereby the stable operation of the vacuum pump is ensured.

4 Claims, 7 Drawing Figures

VACUUM SINTERING FURNACE

BACKGROUND OF THE INVENTION

The present invention generally relates to a vacuum sintering furnace for sintering a pre-compacted workpiece of metal powder, and more particularly to a vacuum sintering furnace including a first section for first eliminating lubricant contained in the workpiece, a second section for subsequently sintering the workpiece, and a third section for cooling the sintered workpiece.

As is well known, the workpiece of metal powder to be compacted generally contains the lubricant such as zinc stearate and paraffin wax by about 1 wt %. The lubricant serves to reduce the friction to be caused between the particles of the metal powder during the compacting process so as to produce a uniform compact. Therefore, the lubricant contained in the compacted workpiece is generally eliminated prior to the sintering process in order to avoid such a problem that the lubricant of the workpiece is vaporized due to the heat for the sintering and adheres onto the cooling surface of the furnace body so as to be solidified in layers.

According to a prior art, the lubricant eliminating process is effected in a specific furnace completely separated from the sintering furnace. Thus, the prior art has such disadvantages that it takes a long time to handle the workpiece in the lubricant eliminating furnace and to carry it into the sintering furnace, and since the workpiece is cooled to some extent when it is discharged out of the lubricant eliminating furnace before the charging of the workpiece into the sintering furnace, a great amount of heat loss is caused so that the fuel costs become high.

SUMMARY OF THE INVENTION

It is therefore an essential object of the present invention to provide a vacuum sintering furnace which comprises a first section for preliminarily eliminating the lubricant from the workpiece and a second section for sintering the workpiece, and in which the heat loss is hardly caused during the movement of the workpiece from the first section into the second section.

It is another object of the present invention to provide a vacuum sintering furnace in which the workpiece processed in the first section can be directly conveyed into the second section without exposure thereof to outside air, while each furnace body of the first and second sections can be independently made gas-tight.

It is a further object of the present invention to provide a vacuum sintering furnace in which the lubricant vaporized in the first furnace body of the first section can be trapped in the vacuum exhaust line connecting the first furnace body to a vacuum pump so that the undesirable entry of the lubricant into the pump may be efficiently prevented.

In accomplishing these and other objects, there is provided a vacuum sintering furnace which comprises a first section having a first furnace body in which a workpiece charged thereinto is heated in vacuum so that lubricant contained in the workpiece is vaporized; a second section having a second furnace body which neighbors with said first furnace body and in which the workpiece charged thereinto from said first furnace body is sintered in vacuum; a third section having a third furnace body which neighbors with said second furnace body and in which the workpiece charged thereinto from said second furnace body is cooled; a first connecting hood means which connects an outlet portion of the first furnace body and an inlet portion of said second furnace body and which is provided with a first door for selectively opening and closing the outlet portion of the first furnace body and a second door for selectively opening and closing the inlet portion of the second furnace body; and a second connecting hood means which connects an outlet portion of said second furnace body and an inlet portion of the third furnace body and which is provided with a third door for selectively opening and closing the outlet portion of said second furnace body. The first furnace body includes therein a carrier means for supporting the workpiece thereon and conveying the workpiece into the second furnace body from the first furnace body, and is connected to a vacuum pump by means of a vacuum exhaust line provided with a lubricant trapping device which is arranged to trap the vaporized lubricant contained in an exhaust gas from said first furnace body. The second furnace body includes therein a lift means for receiving and supporting thereon the workpiece conveyed from the first furnace body. The third furnace body includes therein a carrier means for conveying the workpiece on the lift means into the third furnace body and supporting said workpiece thereon.

With the vacuum sintering furnace according to the present invention as described above, the lubricant eliminating process and the sintering process are independently effected in the corresponding first and second furnace bodies in which the first and second doors between the first and second furnace bodies are closed so that the vaporized lubricant in the first body may be prevented from entering the second furnace body. When the workpiece has processed in the first furnace body, the first and second doors are opened in order to communicate the interior of the first and second furnace bodies with each other so that the workpiece may be transferred from the first furnace body into the second furnace body. Thus, the heat energy imparted to the workpiece in the first furnace body is hardly lost during the transfer of the workpiece from the first furnace body to the second furnace body. On the other hand, the lubricant eliminating process and the sintering process can be respectively effected independently to each other by closing the first and second doors between the outlet portion of the first body and inlet portion of the second body.

Furthermore, since the lubricant vaporized from the workpiece is trapped by the lubricant trapping device, the vacuum pump connected to the first body is hardly soiled by the lubricant so that the stable operation of the vacuum pump is advantageously ensured.

BRIEF DESCRIPTION OF THE DRAWINGS

These and other objects and features of the present invention will become apparent from the following description taken in conjunction with the preferred embodiments thereof, with reference to the accompanying drawings in which.

DETAILED DESCRIPTION OF THE INVENTION

Figure 1:
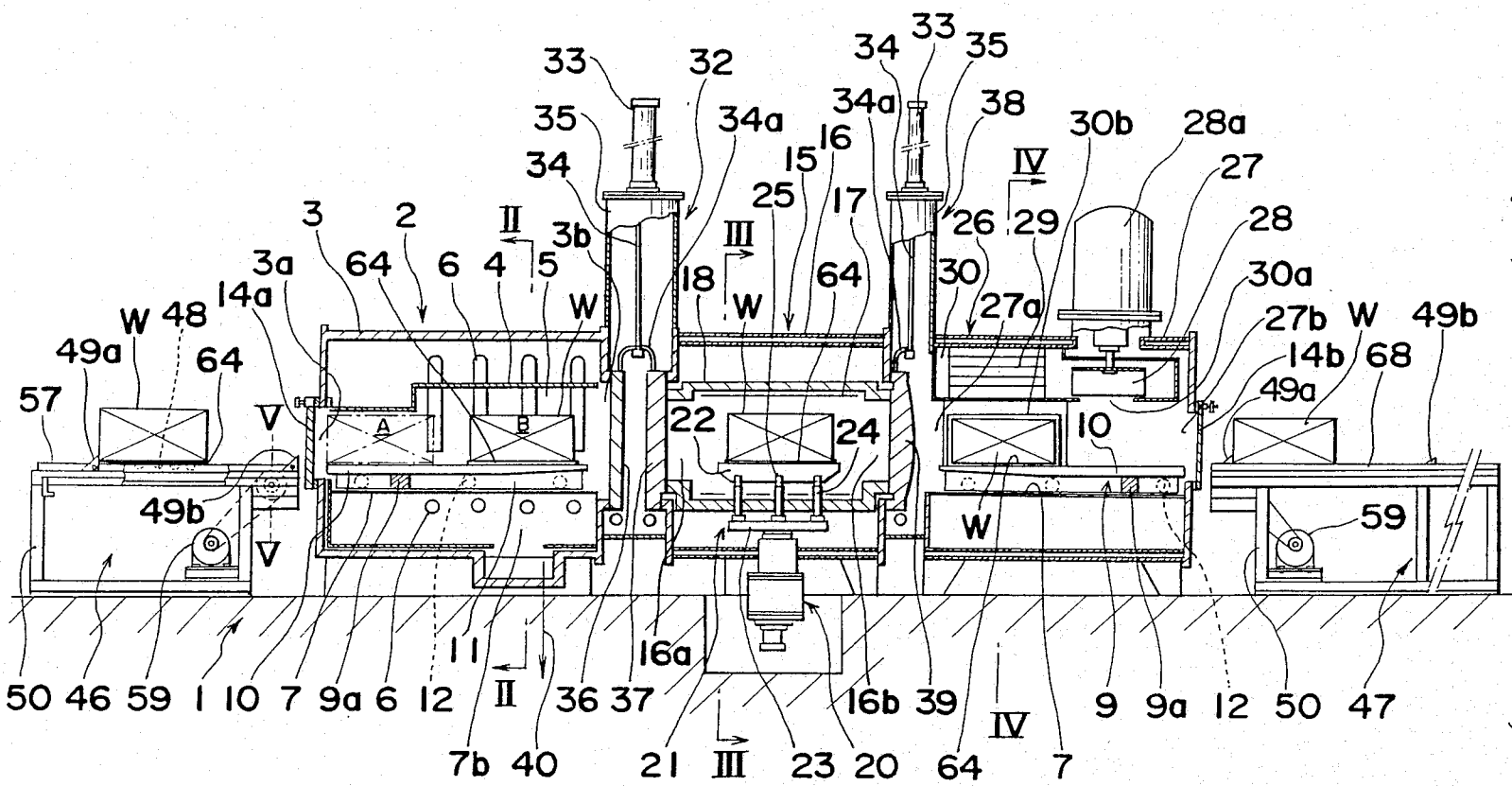
FIG. 1 is a longitudinally sectioned schematic view showing a vacuum sintering furnace according to one preferred embodiment of the present invention.

Before the description of the present invention proceeds, it is to be noted that like parts are designated by like reference numerals and symbols throughout several views of the accompanying drawings.

Referring first to FIG. 1, there is shown a vacuum sintering furnace 1 according to one preferred embodiment of the present invention which comprises a furnace body divided into three sections 2, 15 and 26 along the longitudinal direction of the furnace body, a workpiece charging table 46 arranged at the left side of said first section 2, and a workpiece discharging table 47 arranged at the right side of said third said third section 26. A first furnace body 3 of the first section 2 and a second furnace body 16 of the second section 15 are connected to each other by means of a first connecting hood means 32, while the second furnace body 16 of the second section 15 and a third furnace body 27 of the third section 26 are connected to each other by means of a second connecting hood means 38.

Figure 6:
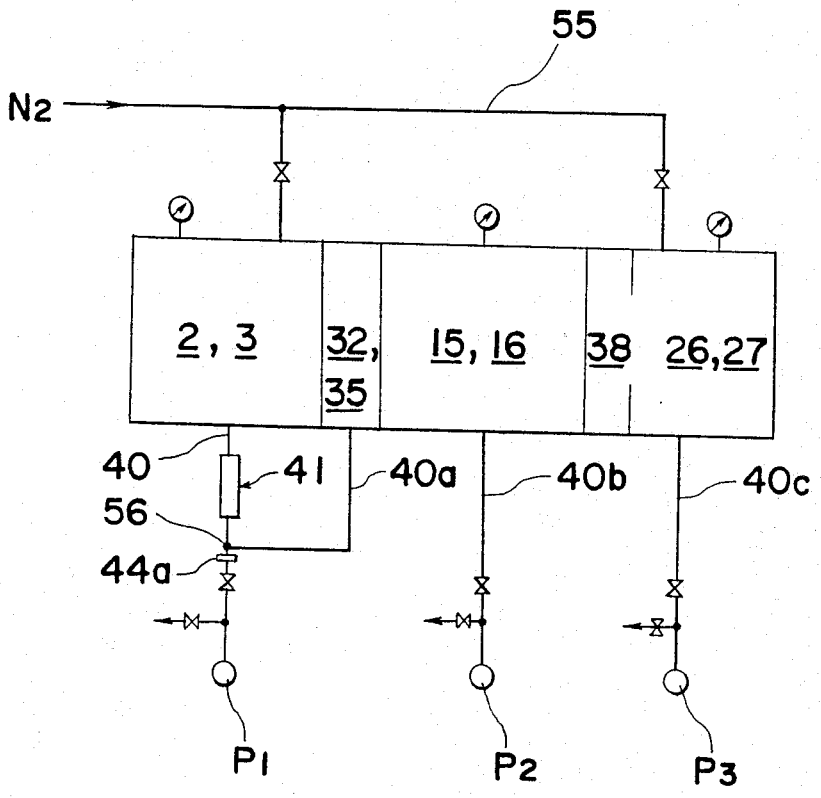
FIG. 6 is a diagram showing a piping arrangement of the vacuum sintering furnace in FIG. 1.

Referring to FIG. 6, the furnace bodies 3 and 27 are respectively connected, on one hand, to a nitrogen gas supply line 55, while the furnace bodies 3, 16 and 27 are respectively connected to the corresponding vacuum pumps P1, P2 and P3 by means of exhaust lines 40, **40*b* and 40*c*. A lubricant trapping device 41 and a filter 44*a* are separately mounted on the exhaust line 40. A hood 35 of the connecting hood means 32 is connected by means of a by-pass line 40*a* to the exhaust line 40 at an intermediate point 56 between the lubricant trapping device 41 and the filter 44*a***.

Figure 5:
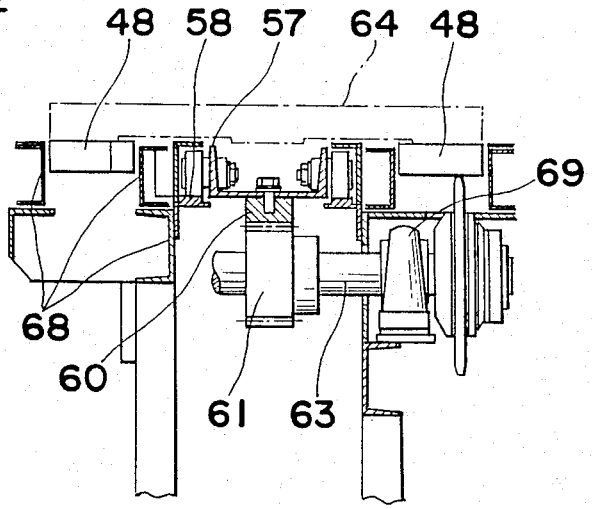
FIG. 5 is an enlarged cross-sectional view taken along a line V—V in FIG. 1.

Referring to FIGS. 1 and 5, the workpiece charging table 46 has a frame 68 secured on a support column 50, a pair of guide rails 58 secured to the frame 68, a claw holder 57 extending between the pair of guide rails 58 and being movably supported by the guide rails 58.

The claw holder 57 has, at the rear and front end portions thereof, a pair of triangular claws **49*a* and 49*b*, and a rack 60 secured on the bottom surface of the claw holder 57. The rack 60 is in mesh with a pinion 61 secured to a rotational shaft 63 which is rotatably mounted on a bearing 69 supported on the frame 68. The rotational shaft 63 is driven by an electric motor 59 so that the rack 60 in mesh with the pinion 61 may move forwardly and backwardly together with the claw holder 57. In addition, the frame 68 has a plurality of rollers 48 which align at each outer portion of the guide rails 58 to slidably support a tray 64 arranged to receive the workpiece W thereon and to be engaged with the claws 49*a* and 49*b*** at the rear end portion thereof.

Figure 2:
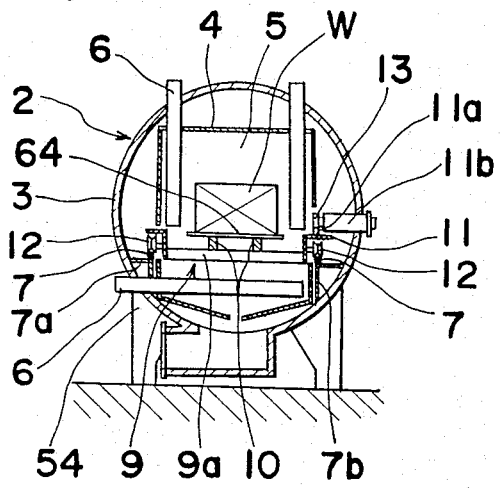
FIGS. 2, 3 and 4 are respectively sectional views taken along lines II—II, III—III and IV—IV in FIG. 1.

Referring to FIGS. 1 and 2, the first section 2 for eliminating the lubricant contained in the workpiece W has, in the furnace body 3 thereof, a reflection plate 4 forming a heating chamber 5 in which a plurality of heaters 6 are arranged. A carrier 9 for supporting the workpiece W thereon is arranged in the heating chamber 5 so as to move forwardly and backwardly. The carrier 9 comprises a pair of support bars 10 and a pair of side bars 11 respectively extending in parallel relationship along the direction of advancement of the workpiece W, a cross bar **9*a* for integrally connecting the support bars 10 and side bars 11, a plurality of wheels 12 which are respectively mounted on the outside of the side bars 11 so as to ride on the guide rails 7 mounted on the corresponding support plates 7*a* and 7*b* in the furnace body 3, and a rack 11 a mounted on one of the side bars 11. An electric motor 11*b* is supported on the furnace body 3 to drive a pinion 13 in mesh with the rack 11*a*. Thus, by driving the motor 11*b*, the carrier 9 can move forwardly and backwardly on the guide rails 7**.

The furnace body 3 has, on one hand, an inlet **3*a* for charging the workpiece W thereinto from the workpiece charging table 46 and, on the other hand, an outlet 3*b* for discharging the workpiece W on the carrier 9 into the furnace body 16 of the section 15 via the hood 35. The inlet 3*a* is provided with a charging door 14*a* which selectively opens and closes the inlet 3*a***.

The pair of support bars 10 for supporting the workpiece W thereon are in substantially the same height as the rollers 48 of the table 46 to receive the workpiece W from the rollers 48. With respect to the table 46, when the motor 59 is driven, the claw holder 57 moves forwardly, with the claw **49*a* engaged with the rear portion of the tray 64 so that the workpiece W may be placed on the support bars 10 of the carrier 9 at a rear position A indicated by the dot-dash line in FIG. 1. When the workpiece W is conveyed to the position A, the claw holder 57 is driven to return once. It is to be noted that when the claw 49*b* contacts the workpiece W at the position A, the claw 49*b* rotates in the clockwise direction in FIG. 1 so that the upwardly projecting portion of the claw 49*b* is lowered to pass under the workpiece W. When the claw 49*b* has passed the workpiece W, the claw 49 reversely rotates by means of a return spring (not shown) incorporated in the claw 49*b* to be able to engage with the rear portion of the workpiece W. Subsequently, the claw holder 57 is driven again to advance so that the claw 49*b* forwardly pushes the workpiece W at the position A on the support bars 10** to the front position B indicated by a solid line.

Figure 3:
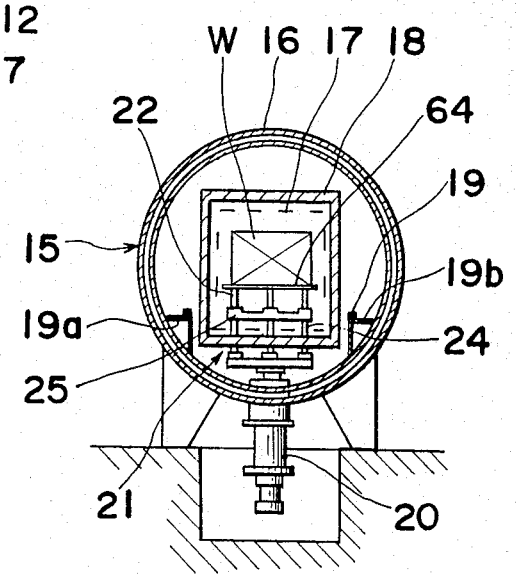

Referring to FIGS. 1 and 3, the furnace body 16 of the second section 15 is of the type of water-cooling jacket. In the furnace body 16, there is provided a heat housing 18 in which the introduced workpiece W is sintered by receiving the heat from a heater 17 accommodated in the heat housing 18. The workpiece W is supported in the heat housing 18 by a skid 21 which comprises a plurality of support plates 22 for supporting the workpiece W thereon, a plurality of bar members 25 for connecting the support plates 22, a plurality of support rods 24 passing through the bottom wall of the heat housing 18 to connect the bar members 25 to a support table 23 placed between the heat housing 18 and the furnace body 16, and a hydraulic cylinder 20 for controlling the height of the support plate 22 in the heat housing 18. In addition, as shown best in FIG. 3, there is provided, in the furnace body 16, the opposed support plates **19*a* and 19*b* on which a pair of guide rails 19 are mounted so as to align with the corresponding guide rails 7*a* and 7*b* in the furnace body 3 of the first section 2 so that the wheels 12 of the carrier 9 may ride on the guide rails 19**.

Figure 4:
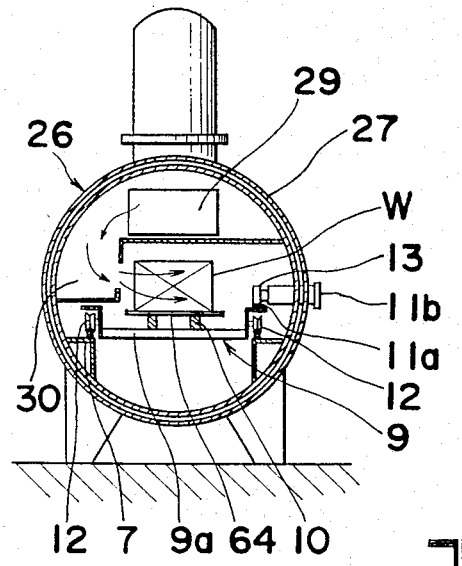

Referring to FIGS. 1 and 4, the furnace body 27 of the third section 26 is also of the type of water-cooling jacket. The furnace body 27 is provided therein with a fan pump 28 which is driven by an electric motor **28*a* to circulate the atmospheric gas in the furnace body 27, a cooling device 29 for cooling the atmospheric gas in the furnace body 27, and a carrier 9 which is of the same construction as that of the carrier 9 arranged in the furnace body 3 but is reversely orientated with respect to the direction of the advancement of the workpiece W. As the driving mechanism for moving the carrier 9 forwardly and backwardly is the same as that of the carrier 9 in the first section, the detailed explanation thereof is omitted here, and the same parts are indicated by the same reference numerals. In addition, the circulation fan 28 and the cooling device 29 are accommodated in a duct 30 arranged in the furnace body 27. The duct 30 has an inlet 30***a* at a portion under the circulation fan 28 and an outlet 30*b* at a portion beside the workpiece W supported by the carrier 9. The atmospheric gas in the furnace body 27 is drawn by the circulation fan 28 into the duct 30 through the inlet 30*a*, is subsequently cooled by the cooling device 29, and finally is exhausted toward the workpiece W on the carrier 9. Furthermore, the furnace body 27 has an inlet 27*a* for charging the workpiece W from the furnace body 16, and an outlet 27*b* for discharging the workpiece W toward the workpiece discharging table 47. The outlet 27*b* is provided with a discharging door 14*b*.

The connecting hood means 32 comprises the hood 35 which covers the space between the opposed end portions of the furnace bodies 3 and 16 to connect them to each other, and a pair of heat insulating doors 36 and 37 which are respectively suspended via a connecting member 34*a* to a lower end of a piston rod 34 of a hydraulic cylinder 33 mounted on the top of the hood 35 so as to selectively open and close the outlet 3*b* of the furnace body 3 and an inlet 16*a* of the furnace body 16. The doors 36 and 37 at the closed position are respectively pushed to the outlet 3*b* and the inlet 16*a* by pushing means (not shown) so as to respectively make the furnace bodies 3 and 16 gas-tight.

The other connecting hood means 38 is of substantially the same construction as the above hood means 32, except having only one heat insulating door 39 for selectively opening and closing an outlet 16*b* of the furnace body 16. The inlet 27*a* of the furnace body 27 is always open to the hood 35.

The workpiece discharging table 47 neighboring to the furnace body 27 is substantially the same as the workpiece charging table 46, except that the claw holder thereof is relatively longer than that of the workpiece charging table 46, and the arrangement such as the motor 59 thereof is different from that of the workpiece charging 46. Therefore, the detailed explanation about the workpiece discharging table 47 is omitted here, and the same parts are indicated by the same reference numerals.

Figure 7:
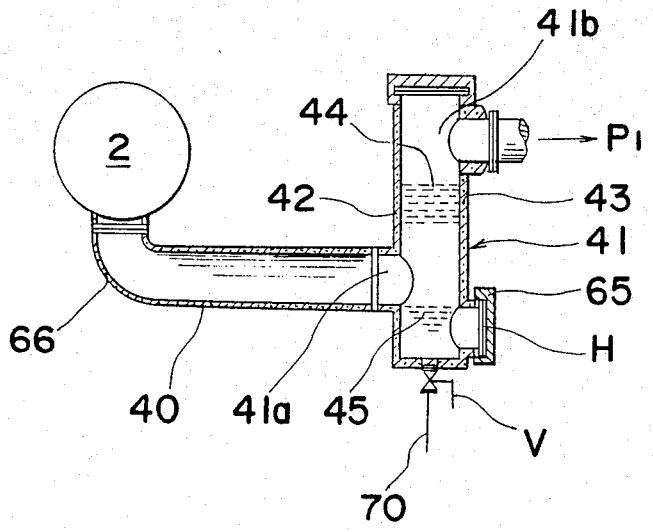
FIG. 7 is an enlarged sectional view of a lubricant trapping device shown in FIG. 5.

Referring to FIG. 7, the lubricant trapping device 41 comprises a body 42 having, at its lower position, an inlet port 41*a* and at its upper position an outlet port 41*b*. The inlet port 41*a* and the outlet port 41*b* are respectively connected to the upstream and downstream of the exhaust line 40. The body 42 also has a bottom storage 45 for storing therein the liquefied lubricant, and the bottom storage 45 is connected to a drain line 70 with a drain cock V. A filter 44 is arranged between the inlet 41*a* and outlet 41*b* to liquefy the vaporized lubricant. The upstream of the exhaust line 40 and the filter 44 respectively have, in the walls thereof, heat wires 66 and 43 for keeping the temperature of the interior of the exhaust line 40 and the body 42 slightly higher than the solidifying point of the lubricant for the purpose of liquefying the vaporized lubricant. In addition, the body 42 has at its lower position a window H through which the operator may observe the interior of the bottom storage 45, and which is provided with a cap 65.

The operation of the vacuum sintering furnace having the construction as described above is as follows.

The workpiece W is first loaded on the tray 64 disposed on the workpiece charging table 46, as shown in FIG. 1. At this time, the charging door 14*a* is opened, while the pair of heat insulating doors 36 and 37 of the connecting hood means 32 are closed. The workpiece W is charged into the furnace body 3 of the first section 2 through the inlet 3*a* by driving the table 46. The workpiece W charged into the furnace body 3 is placed on the support bars 10 of the carrier 9 at a position B as shown in FIG. 1. Subsequently, the charging door 14*a* is closed, and the workpiece W in the furnace body 3 is heated for the purpose of vaporizing the lubricant included in the workpiece W.

Meanwhile, the solidifying point and the boiling point of the lubricant is generally 100 to 150° C. and around 300° C. Thus, the interior of the furnace body 3 is kept around 500° C., after the atmospheric gas in the furnace body has been exhausted by the vacuum pump P1 to establish the vacuum condition of about $10^{-2}$ torr. Subsequently, the furnace body 3 is continuously charged, with a charging speed of 10 liters per minite, by an inert gas such as nitrogen gas which serves as a carrier gas for exhausting the vaporized lublicant, and results that the lublicant eliminating process is effected under the atmospheric gas of about $5\times10^{-1}$ torr which value is slightly lowered at the degree of vacuum by the introduction of the carrier gas. The lubricant contained in the workpiece W is efficiently vaporized in vacuum. The vaporized lubricant is exhausted together with the nitrogen gas through the exhaust line 40 and trapped by the device 41. The upstream of the exhaust line 40 and the device 42 are heated by the heat wires 66 and 43 to keep their interior at the temperature slightly higher than the solidifying point of the lubricant. Thus, the exhausted lubricant having a temperature of around 500° C. is first cooled in the upstream of the exhaust line 40 to be liquefied. The liquefied lubricant is collected in the bottom storage 45 without solidification. The lubricant reaching the body 42 of the device 41 in the form of vapor is subsequently liquefied during the passing through the filter 44 to drop down into the bottom storage 45. Although the lubricant contained in the exhaust gas is almost trapped by the device 41, the slight amount of lubricant still contained in the exhaust gas is subsequently trapped by the filter 44*a* which is kept at a normal temperature, so that the lubricant may be solidified in the filter 44*a*. Accordingly, the lubricant contained in the exhaust gas hardly reaches the vacuum pump P1 so that the stable operation of the pump P1 may be ensured. When the lubricant eliminating process for the workpiece W is finished, the pair of doors 36 and 37 are lifted by driving the cylinder 33 to be opened. It is to be noted that, this time, the other door 39 is kept closed, and the interior of the furnace bodies 3 and 16 are respectively kept in vacuum. After opening of the doors 36 and 37, the carrier 9 is driven to forwardly move on the guide rails 7 and 19 toward the skid 21 taking the lower position below the workpiece conveyed. Subsequently, the skid 21 is lifted to the upper position to receive the workpiece W from the support bars 10 of the carrier 9, and the carrier 9 is returned into the furnace body 3, and the doors 36 and 37 are closed. The workpiece W in the furnace body 16 is heated in vacuum to be efficiently sintered for a predetermined time.

When the sintering process has been finished, the door 39 is opened to communicate the interiors of the furnace bodies 16 and 27 with each other. It is to be noted that, at this time, the discharging door 14*b* is closed and the furnace body 27 is also kept in vacuum in order to ensure the vacuum in the furnace body 16. Subsequently, carrier 9 in the furnace body 27 is driven to backwardly move into the furnace body 16 and below the skid 21. The skid 21 is subsequently lowered so that the workpiece W is received by the support bars 10 of the carrier 9 from the skid 21, and the carrier 9 returns into the furnace body 27. Subsequently, the door 39 is closed, and the driving of the vacuum pump P3 is stopped, while the nitrogen gas is charged into the furnace body 27. Accordingly, the cooling process is effected in the atmosphere of nitrogen gas so that the chemical reaction of the workpiece such oxidation is efficiently avoidable.

When the cooling process has been finished, the discharging door 14*b* is opened, and the workpiece discharging table 47 is driven so that the claw holder 57 backwardly moves into the furnace body 27 under the workpiece W on the carrier 9. The rear portion of the claw holder 57 is shifted under the workpiece W such that the claw 49*b* rotates in the clockwise direction when the claw 49*b* contacts the workpiece W. When the claw 49*b* has passed through the workpiece W, the claw 49*b* returns so that the upwardly projecting portion thereof rises to engage to the rear portion of the workpiece W. Subsequently, the claw holder 57 is forwardly moved so that the workpiece W is discharged from the furnace body 27 as shown in FIG. 1.

It will be apparent from the above description that according to the embodiment of the present invention, the workpiece W in the furnace body 3 of the first section 2 can be directly conveyed into the furnace body 16 of the second section 15, so that the heat energy imparted to the workpiece W in the furnace body 3 is hardly lost during the transfer of the workpiece W from the furnace body 3 to the furnace body 16. Furthermore, since the connecting hood means 32 has a pair of doors 36 and 37 for opening and closing the outlet 3*b* of the furnace body 3 and the inlet 16*a* of the furnace body 16, and the door 39 for opening and closing the outlet 16*b* of the furnace body 16, the furnace bodies 3, 16 and 27 are respectively made independent from each other so that the lubricant eliminating process, sintering process and cooling process are respectively effected independently and continuously. Still further, the lubricant vaporized in the furnace body 3 can be efficiently trapped by the upstream of the exhaust line, the lubricant trapping device 41 and the filter 44*a* so that the pump P1 is prevented from being soiled by the lubricant and resulting in that the stable operation of the pump P1 is ensured. In addition, the temperature of the upstream of the exhaust line 40 and the body 42 of the device 41 are maintained slightly higher than the solidifying point of the lubricant, so that the lubricant trapped in the upstream of the exhaust line 40 and the body 42 of the device 41 can be collected in the form of a liquid. Thus, the maintenance of the exhaust line 40 and the device 41 are advantageously facilitated.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A vacuum sintering furnace which comprises:

a first section having a first furnace body in which a workpiece charged thereinto is heated in vacuum so that lubricant contained in said workpiece is vaporized;

a second section having a second furnace body which neighbors with said first furnace body and in which said workpiece charged thereinto from said first furnace body is sintered in vacuum;

a third section having a third furnace body which neighbors with said second furnace body and in which the said workpiece charged thereinto from said second furnace body is cooled;

a first connecting hood means which connects an outlet portion of said first furnace body and an inlet portion of said second furnace body and which is provided with a first door for selectively opening and closing the outlet portion of said first furnace body and a second door for selectively opening and closing the inlet portion of said second furnace body; and a second connecting hood means which connects an outlet portion of said second furnace body and an inlet portion of said third furnace body and which is provided with a third door for selectively opening and closing the outlet portion of said second furnace body;

said first furnace body including therein a carrier means for supporting the workpiece thereon and conveying the workpiece into said second furnace body from said first furnace body, and being connected to a vacuum pump by means of a vacuum exhaust line provided with a lubricant trapping device which is to trap the vaporized lubricant contained in an exhaust gas from said first furnace body;

said second furnace body including therein a lift means for receiving and supporting therein the workpiece conveyed from said first furnace body;

said third furnace body including therein a carrier means for conveying the workpiece on said lift means into said third furnace body and supporting said workpiece thereon.

2. A vacuum sintering furnace as claimed in claim 1, wherein the first and second connecting hood means respectively have door driving means which move said doors upwardly and downwardly to selectively open and close the outlet portion of the first furnace body and the inlet portion and outlet portion of the second furnace body.

3. A vacuum sintering furnace as claimed in claim 1, wherein said lubricant trapping device and an upstream of said exhaust line with respect to said lubricant trapping device respectively have heating means which keep their interior at a temperature slightly higher than the solidifying point of said lubricant to liquefy the vaporized lubricant included in said exhaust gas.

4. A vacuum sintering furnace as claimed in claim 3, wherein said lubricant trapping device comprises a filter which liquefies the vaporized lubricant included in the exhaust gas when said exhaust gas passes through the filter, and a bottom storage for storing the lubricant liquefied in said lubricant trapping device in said upstream of said exhaust line.

* * * * *